US010238901B2

(12) United States Patent
Ferguson et al.

(10) Patent No.: US 10,238,901 B2
(45) **Date of Patent: *Mar. 26, 2019**

(54) CARGO FIRE-SUPPRESSION AGENT DISTRIBUTION SYSTEM

(71) Applicant: THE BOEING COMPANY, Chicago, IL (US)

(72) Inventors: Douglas E. Ferguson, Cypress, CA (US); Arthur L. Tutson, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 63 days.

This patent is subject to a terminal disclaimer.

(21) Appl. No.: 15/357,714

(22) Filed: Nov. 21, 2016

(65) Prior Publication Data

US 2017/0072235 A1 Mar. 16, 2017

Related U.S. Application Data

(63) Continuation of application No. 13/707,616, filed on Dec. 7, 2012, now Pat. No. 9,526,931.

(51) Int. Cl.
*A62C 37/00* (2006.01)
*A62C 3/08* (2006.01)
(Continued)

(52) U.S. Cl.
CPC ..... *A62C 3/08* (2013.01); *A62C 37/04* (2013.01); *A62C 37/36* (2013.01); *A62C 99/0018* (2013.01)

(58) Field of Classification Search
CPC . A62C 3/08; A62C 37/36; B61L 25/02; B61L 25/025
(Continued)

(56) References Cited

U.S. PATENT DOCUMENTS 6,491,254 B1 * 12/2002 Walkinshaw ..... A62C 3/08 244/118.5
7,066,274 B2 * 6/2006 Lazzarini ..... A62C 3/08 169/16
(Continued)

OTHER PUBLICATIONS

Napert, Class D to C Conversions: A review of cargo fire detection/suppression requirements, Nov. 1, 1999, AviationPros http://www.aviationpros.com/article/10388905/class-d-to-c-conversions-a-review-of-cargo-fire-detection-suppression-requirements.*
(Continued)

*Primary Examiner* — Viet Le
(74) *Attorney, Agent, or Firm* — McDonnell Boehnen Hulbert & Berghoff LLP

(57) ABSTRACT

A cargo-fire-suppression agent distribution system and methods are presented. A fire-warning signal indicating presence of fire in a cargo compartment onboard a class E cargo aircraft at a first altitude is received. An initial fire-suppression agent is distributed in the cargo compartment at the first altitude sufficient to suppress fire for an initial fire suppression time interval during a depressurization phase during which the class E cargo aircraft flies to a second altitude below the first altitude. A re-enforcing fire-suppression agent is distributed in the cargo compartment during a re-pressurization phase when a cabin altitude is below a predetermined cabin pressure level (PL) during which the class E cargo aircraft flies from the second altitude to a landing, after the initial fire-suppression time interval elapses. The re-enforcing fire-suppression agent distribution is maintained during a re-enforcing fire-suppression time interval.

16 Claims, 6 Drawing Sheets

(51) Int. Cl.
*A62C 37/36* (2006.01)
*A62C 99/00* (2010.01)

(58) Field of Classification Search
USPC ..... 169/56, 60, 61, 62, 46
See application file for complete search history.

(56) References Cited

U.S. PATENT DOCUMENTS

| | | | |
|---|---|---|---|
| 2005/0183869 | A1 | 8/2005 | Lazzarini |
| 2012/0168184 | A1 | 7/2012 | Enk |

OTHER PUBLICATIONS

Napert, Class D to C conversions: A review of cargo fire detection/suppression requirements, Nov. 1, 1999, AviationPros http://aviationpros.com/article/10388905/class-d-to-c-conversions-a-review-of-cargo-fire-detection-suppression-requirements.
European Search Report for corresponding European Application No. 131960965.5, dated Apr. 5, 2017.

* cited by examiner

CARGO FIRE-SUPPRESSION AGENT DISTRIBUTION SYSTEM

CROSS-REFERENCE TO RELATED APPLICATIONS

This application is a continuation of U.S. patent application Ser. No. 13/707,616 filed Dec. 7, 2012, the contents of which is hereby incorporated by reference.

FIELD

Embodiments of the present disclosure relate generally to fire-suppression. More particularly, embodiments of the present disclosure relate to fire-suppression methods for fire-suppression agent distribution.

BACKGROUND

Fire-suppression may refer to a use of agents such as gases, liquids, solids, chemicals and mixtures thereof to extinguish combustion. Fire-suppression systems generally use a "total flooding" or a "non-total flooding" method to apply an extinguishing agent in an enclosed volume. The total flooding or the non-total flooding method may achieve a concentration of the extinguishing agent as a volume percent to air of the extinguishing agent sufficient to suppress or extinguish a fire.

Existing all-cargo aircraft generally have class E cargo compartments that do not have active fire-suppression agent capability. A fire on these aircraft is generally controlled by shutting off ventilation into the class E cargo compartment, depressurizing the aircraft, and landing at a nearest suitable airport. While the aircraft is depressurized, an active flame is suppressed due to a low oxygen partial pressure above 6.1 km (20,000 feet). Although the fire is suppressed at altitudes above 6.1 km (20,000 feet), the fire may continue to smolder.

SUMMARY

A cargo-fire-suppression agent distribution system and methods are presented. A fire-warning signal is received indicating presence of fire in a cargo compartment onboard a class E cargo aircraft at a first altitude. An initial fire-suppression agent is distributed in the cargo compartment at the first altitude sufficient to suppress fire for an initial fire suppression time interval during a depressurization phase during which the class E cargo aircraft flies to a second altitude below the first altitude. A re-enforcing fire-suppression agent is distributed in the cargo compartment during a re-pressurization phase when a cabin altitude is below a predetermined cabin pressure level (PL) during which the class E cargo aircraft flies from the second altitude to a landing, after the initial fire-suppression time interval elapses. Distribution of the re-enforcing fire-suppression agent is maintained during a re-enforcing fire-suppression time interval.

In this manner, various embodiments of the disclosure provide a system and method for suppressing fire using an enhance class E fire-suppression distribution system based on an operational condition.

In an embodiment, a method for enhancing fire-suppression for a class E Cargo aircraft receives a fire-warning signal indicating presence of fire in a cargo compartment onboard a class E cargo aircraft at a first altitude. The method then distributes an initial fire-suppression agent in the cargo compartment at the first altitude sufficient to suppress fire for an initial fire suppression time interval during a depressurization phase during which the class E cargo aircraft flies to a second altitude below the first altitude. The method then distributes a re-enforcing fire-suppression agent in the cargo compartment during a re-pressurization phase when a cabin altitude is below a predetermined cabin pressure level (PL) during which the class E cargo aircraft flies from the second altitude to a landing, after the initial fire-suppression time interval elapses. The method then maintains distribution of the re-enforcing fire-suppression agent during a re-enforcing fire-suppression time interval.

In another embodiment, a cargo fire-suppression agent distribution system onboard a class E cargo aircraft comprises a fire detector, a fire-suppression agent time determination module, and a controller. The fire detector receives a fire-warning signal indicating presence of fire in a cargo compartment at a first altitude. The fire-suppression agent time determination module activates an initial fire suppression agent and a re-enforcing fire suppression agent at a first activation time and a second activation time respectively. The controller distributes the initial fire-suppression agent in the cargo compartment at the first altitude sufficient to suppress fire for a duration of an initial fire-suppression time interval during which the class E cargo aircraft enters a depressurization phase and flies to a second altitude below the first altitude. The controller further distributes the re-enforcing fire-suppression agent in the cargo compartment after the initial fire-suppression time interval elapses during a re-pressurization phase, when a cabin altitude is below a predetermined cabin pressure level (PL) and the aircraft descends from the second altitude to a landing. The controller further maintains distribution of the re-enforcing fire-suppression agent during the re-enforcing fire suppression agent time interval.

In a further embodiment, a non-transitory computer readable storage medium comprising computer-executable instructions for distributing a fire-suppression agent in a cargo compartment receives a fire-warning signal indicating presence of fire in a cargo compartment onboard a class E cargo aircraft at a first altitude. The computer-executable instructions further distribute an initial fire-suppression agent in the cargo compartment at the first altitude. The computer-executable instructions further distribute an initial fire-suppression agent in the cargo compartment at the first altitude sufficient to suppress fire for an initial fire suppression time interval during which the class E cargo aircraft enters a depressurization phase and flies to a second altitude below the first altitude. The computer-executable instructions further distributes a re-enforcing fire-suppression agent in the cargo compartment after the initial fire-suppression time interval elapses during a re-pressurization phase when a cabin altitude is below a predetermined cabin pressure level (PL) during which the class E cargo aircraft flies from the second altitude to a landing. The computer-executable instructions further maintains distribution of the re-enforcing fire-suppression agent during a re-enforcing fire suppression time interval.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF DRAWINGS

A more complete understanding of embodiments of the present disclosure may be derived by referring to the detailed description and claims when considered in conjunction with the following figures, wherein like reference numbers refer to similar elements throughout the figures. The figures are provided to facilitate understanding of the disclosure without limiting the breadth, scope, scale, or applicability of the disclosure. The drawings are not necessarily made to scale.

DETAILED DESCRIPTION

The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. The present disclosure should be accorded scope consistent with the claims, and not limited to the examples described and shown herein.

Embodiments of the disclosure may be described herein in terms of functional and/or logical block components and various processing steps. It should be appreciated that such block components may be realized by any number of hardware, software, and/or firmware components configured to perform the specified functions. For the sake of brevity, conventional techniques and components related to fire-suppression techniques, fire suppressants, ducting systems, and other functional aspects of the systems (and the individual operating components of the systems) may not be described in detail herein. In addition, those skilled in the art will appreciate that embodiments of the present disclosure may be practiced in conjunction with a variety of structural bodies, and that the embodiments described herein are merely example embodiments of the disclosure.

Embodiments of the disclosure are described herein in the context of a non-limiting application, namely, aviation of cargo hold fire-suppression. Embodiments of the disclosure, however, are not limited to such aviation cargo hold applications, and the techniques described herein may also be utilized in other fire-suppression applications. For example but without limitation, embodiments may be applicable to, submarine cargo hold fire-suppression, or other similar platform fire-suppression.

As would be apparent to one of ordinary skill in the art after reading this description, the following are examples and embodiments of the disclosure and are not limited to operating in accordance with these examples. Other embodiments may be utilized and structural changes may be made without departing from the scope of the exemplary embodiments of the present disclosure.

Figure 1:
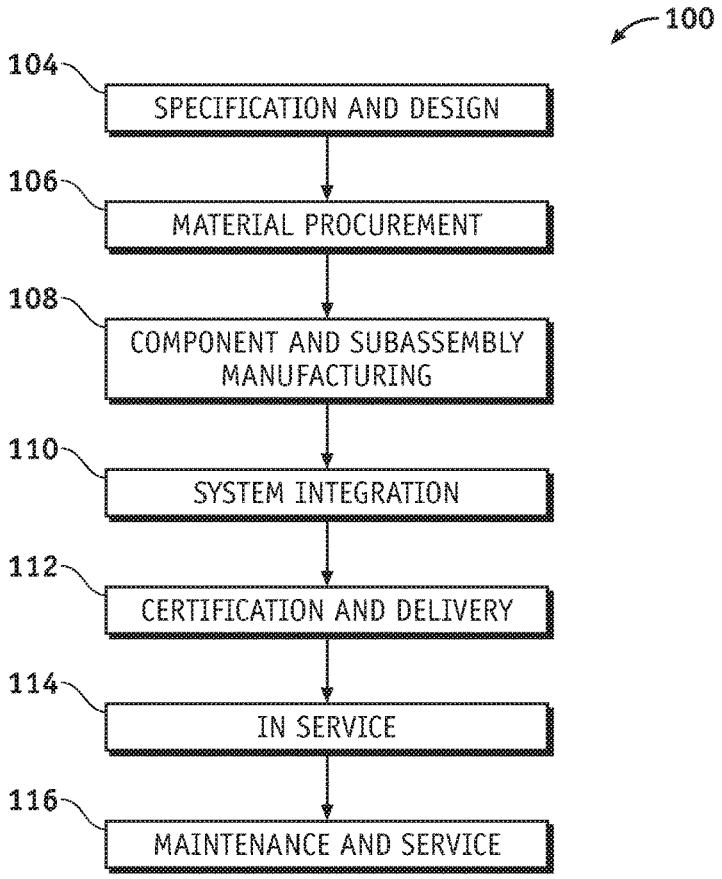
FIG. 1 is an illustration of a flow diagram of an exemplary aircraft production and service methodology.
Figure 2:
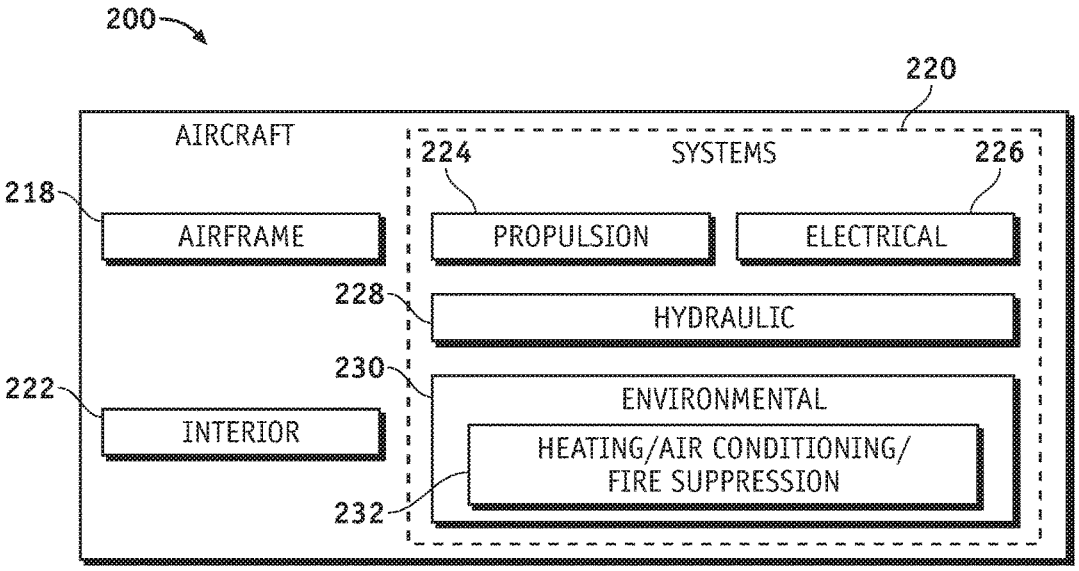
FIG. 2 is an illustration of an exemplary block diagram of an aircraft.

Referring more particularly to the drawings, embodiments of the disclosure may be described in the context of an aircraft manufacturing and service method 100 as shown in FIG. 1 and an aircraft 200 as shown in FIG. 2. During pre-production, the exemplary method 100 may include specification and design 104 of the aircraft 200 and material procurement 106. During production, component and subassembly manufacturing 108 and system integration 110 of the aircraft 200 takes place. Thereafter, the aircraft 200 may go through certification and delivery 112 in order to be placed in service 114. While in service by a customer, the aircraft 200 is scheduled for routine maintenance and service 116 (which may also include modification, reconfiguration, refurbishment, and so on).

Each of the processes of method 100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be without limitation an airline, leasing company, military entity, service organization, and the like.

As shown in FIG. 2, the aircraft 200 produced by the exemplary method 100 may include an airframe 218 with a plurality of systems 220 and an interior 222. Examples of high-level systems 220 include one or more of a propulsion system 224, an electrical system 226, a hydraulic system 228, and an environmental system 230 comprising a cargo fire-suppression agent distribution system 232 (and air conditioning and heating systems). Any number of other systems may also be included. Although an aerospace example is shown, the embodiments of the disclosure may be applied to other industries.

Apparatus and methods embodied herein may be employed during any one or more of the stages of the production and service method 100. For example, components or subassemblies corresponding to production process 108 may be fabricated or manufactured in a manner similar to components or subassemblies produced while the aircraft 200 is in service. In addition, one or more apparatus embodiments, method embodiments, or a combination thereof may be utilized during the production stages 108 and 110, for example, by substantially expediting assembly of or reducing the cost of an aircraft 200. Similarly, one or more of apparatus embodiments, method embodiments, or a combination thereof may be utilized while the aircraft 200 is in service, for example and without limitation, to maintenance and service 116.

Airplane cargo fires may occur at substantially anytime during a flight, such as when an airplane is remote from an airport. Long diversion times (e.g., exceeding five hours or more in some cases such as 330-minute extended operations (ETOPS)) may require a substantial period of cruise before a descent into a suitable airport can be made. Generally, cargo fire-suppression systems should be sufficient to control a fire for an entire diversion to a nearest suitable airport including descent and landing plus a 15 minute margin.

Existing all-cargo aircraft (e.g., freighters) typically have class E cargo compartments that do not have active fire-suppression agent capability. Freighters with class E cargo compartments generally rely on airflow control and generally fly with a depressurized fuselage in order to control potential cargo fires. An aircraft class E fire extinguishing procedure generally comprises shutting off airflow to the cargo compartment, depressurizing the aircraft and maintaining a low oxygen pressure cabin altitude at approximately 7.6 km (25,000 feet) until a suitable airport is close enough to enact a landing.

In some situations, a suitable airport may not be close enough to make an immediate descent and landing, so generally procedures also specify that the aircraft is to remain depressurized at approximately 7.6 km (25,000 feet) until a suitable airport is close enough to descend and land. While the aircraft is depressurized at 7.6 km (25,000 feet), an active flame is suppressed due to the low oxygen partial pressure above 6.1 km (20,000 feet). Although the fire is suppressed at altitudes above 6.1 km (20,000 feet) in this phase, the fire may continue to smolder.

There is a period of time between recognition of the fire and achievement of a suppressed fire state at a cabin pressure level (PL) of 6.1 km (20,000 feet), which varies depending on aircraft depressurization rate and descent rate. By adding a fire-suppression system comprising an active or inert fire-suppression agent during an initial phase while the aircraft is descending and depressurizing (e.g., from 11 km (36,000 feet) to 7.6 km (25,000 feet)), an active fire can be suppressed earlier, thereby reducing possible non-optimal conditions to the aircraft.

The descent and landing phase reintroduces higher oxygen partial pressures due to the reduction in cabin altitude and the fire can reignite and may become a possible non-optimal condition to the aircraft. By introducing an active or inert fire-suppression agent to the cargo compartment during the descent and landing phase, any smoldering fire in the cargo compartment will continue to be suppressed and will not reignite, reducing the possible non-optimal condition to the aircraft.

Figure 3:
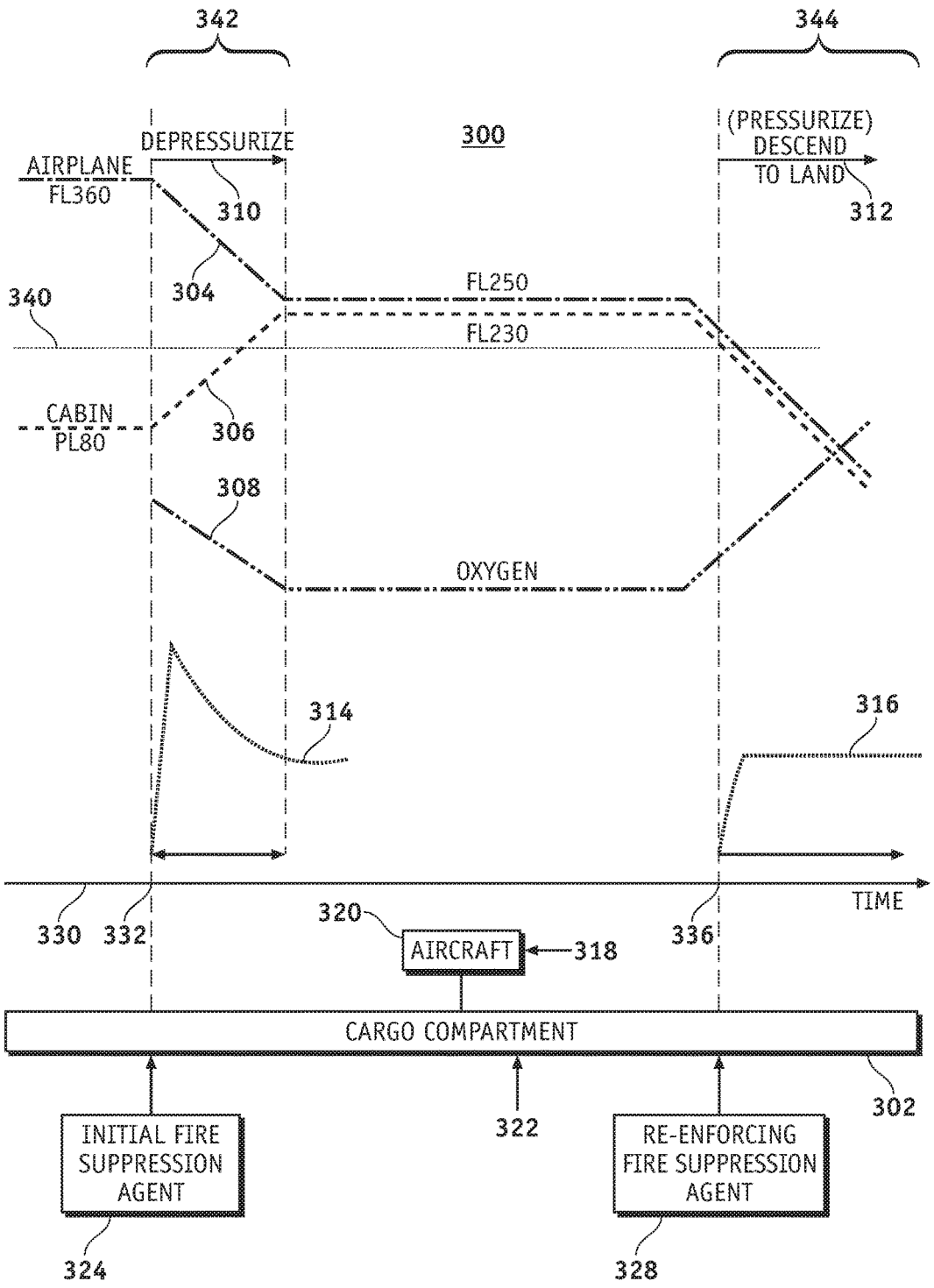
FIG. 3 is an illustration of an exemplary flight profile showing an enhanced fire extinguishing procedure for a class E cargo compartment during various phases of a flight according to an embodiment of the disclosure.

FIG. 3 is an illustration of an exemplary flight profile 300 showing an enhanced fire extinguishing procedure for a class E cargo compartment during various phases of a flight according to an embodiment of the disclosure. The profile 300 shows an aircraft (airplane) flight level (FL) curve 304, a cabin pressure level (PL) curve 306, an oxygen level curve 308, a depressurization phase 310, a pressurization phase 312, an initial fire-suppression agent distribution profile 314, and a re-enforcing fire-suppression agent distribution profile 316 vs. time 330.

Flight levels (FLs) are described by a number, which is nominal altitude ("pressure altitude") in feet, divided by 100, while being a multiple of 152.4 m (500 ft.) therefore end with 0 or 5. Therefore an apparent altitude of, for example, about 9.76 km (32,000 feet) is referred to as "flight level 320". Airplane flight level, aircraft flight level, and pressure altitude may be used interchangeably in this document.

As shown by the flight profile 300, the enhanced fire extinguishing procedure for a class E cargo compartment, receives a fire-warning signal 318 indicating presence of fire/smoke in a cargo compartment 302 onboard the class E cargo aircraft 320 (aircraft 320) at an airplane FL 360 at about 11 km (36,000 feet) equivalent oxygen pressure altitude (first pressure altitude) shown on the airplane FL curve 304, shuts off the airflow 322 to the cargo compartment 302 and distributes the initial fire-suppression agent 324 in the cargo compartment 302 at the airplane FL 360 at a fire-suppression activation time 332 which is an start of an initial fire-suppression time interval T 342. The class E cargo aircraft 320 simultaneously initiates the depressurization phase 310 by flying to an airplane FL 250 at about 7.6 km (25,000 feet) equivalent oxygen pressure altitude (second pressure altitude).

The initial fire-suppression time interval T 342 is defined as a time interval during which the initial fire-suppression agent 324 should maintain fire-suppression capability until the aircraft 320 reaches a low oxygen level that is low enough to maintain fire-suppression. The initial fire-suppression time interval T 342 depends on the aircraft 320 depressurization rate and descent rate. For example, the initial fire-suppression time interval T 342 may be a predetermined time interval $\Delta T$ such as, but without limitation, about 5 minutes, or other value for the class E cargo aircraft 320.

In this manner sufficient initial fire-suppression agent 324 is distributed in the cargo compartment 302 to suppress a fire at about 11 km (36,000 feet) equivalent oxygen pressure altitude (first altitude) for the initial fire-suppression time interval T 342 during the depressurization phase 310 during which the class E cargo aircraft flies to about 7.6 km (25000 feet) equivalent oxygen pressure altitude below the first altitude.

By adding the initial fire-suppression agent 324 during the depressurization phase 310 while the class E cargo aircraft 320 is descending to the airplane flight level 250, an active fire will be suppressed earlier, reducing a fire risk to the class E cargo aircraft 320.

The class E cargo aircraft 320 may then maintain the airplane flight level 250 if the oxygen level is low enough to maintain fire-suppression capability, or may immediately descent to land.

The class E cargo aircraft 320 may then initiate the re-pressurization phase 312 by flying from the airplane flight level 250 to an airplane flight level below about 7.6 km (25,000 feet) equivalent oxygen pressure altitude for landing. A re-enforcing fire-suppression agent 328 is distributed in the cargo compartment 302 during the re-pressurization phase 312 at the fire-suppression activation time 336, when the aircraft FL descends below the aircraft flight level 250 at a predetermined cabin pressure level (PL) 340, after the initial fire-suppression time interval T 342 elapses. The predetermined cabin PL 340 may comprise, for example but without limitation, about 6.1 km (20,000 feet) equivalent oxygen pressure altitude, or other value.

Distribution of the re-enforcing fire-suppression agent 328 is maintained for a re-enforcing fire-suppression time interval 344 (second time interval). The re-enforcing fire-suppression time interval 344 depends on an amount of time for the aircraft 320 to land safely. For example, the re-enforcing fire-suppression time interval 344 may comprise, for example but without limitation, about 23 minutes, 24 minutes, or other values.

The descent and landing phase reintroduces higher oxygen partial pressures due to reduction in cabin pressure level (PL) and the fire can reignite and may become a possible non-optimal condition to the aircraft. By introducing the re-enforcing fire-suppression agent 328 to the cargo compartment 302 during the descent and landing phase, any smoldering fire in the cargo compartment 302 will continue to be suppressed and will not reignite, reducing the possible non-optimal condition to the aircraft 320.

An enhanced class E system such as a class E cargo compartment fire-suppression system 400 (FIG. 4) described herein manually or automatically provides immediate active or inert fire-suppression agent to the class E compartment 302 while the aircraft 320 is depressurizing during the depressurization phase 310 and descending in altitude to about 7.6 km (25,000 feet). The system 400 will also manually or automatically provide an active or inert fire-suppression agent for the descent and landing phase during the re-pressurization/pressurization phase 312 after the cabin pressure level (PL) descends below the predetermined cabin PL 340 such as below approximately 6.1 km (20,000 feet). Providing the initial fire-suppression agent 324 during the (initial) depressurization phase 310 and the re-enforcing fire-suppression agent 324 during the re-pressurization phase 312 reduces a possible non-optimal condition of fire to the aircraft.

Embodiments of the disclosure utilize an existing depressurization capability of a freighter aircraft to address a potentially long duration needed for fire-suppression if the aircraft is not close to an airport. Embodiments of the disclosure do not require new operational procedures from aircraft operators, and do not require use of non-standard cargo containers or usage of potentially difficult to install pallet covers. Enhancing existing capabilities of a class E cargo compartment, rather than designing a new system that operates independently of the class E features, designing new containers, or implementing a complete fire-suppression system that maintains an inerting concentration for a remainder of a flight provides significant weight, cost and operational saving.

A contained volume 302, a cargo compartment 302, and a cargo volume 302 may be used interchangeably in this document.

Figure 4:
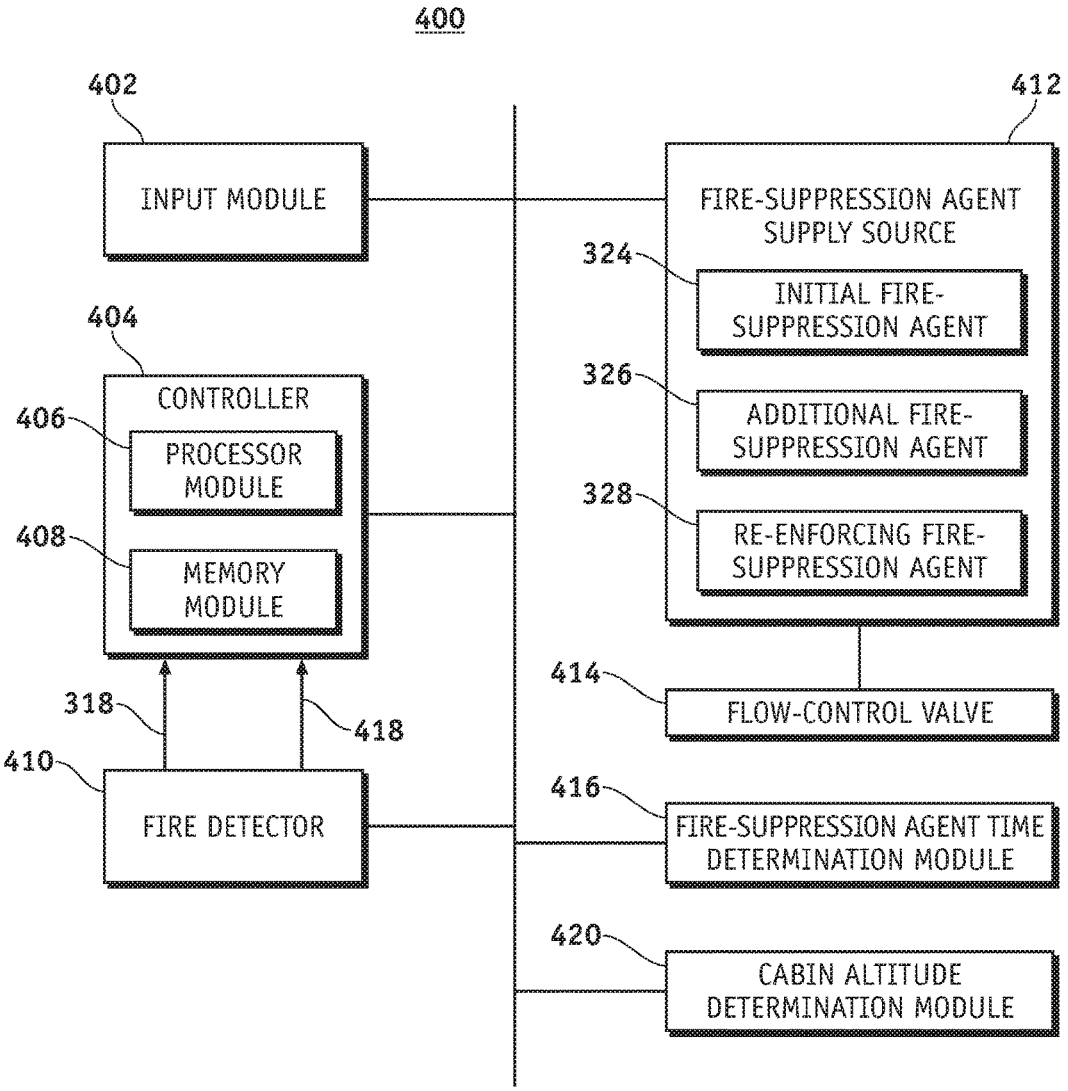
FIG. 4 is an illustration of an exemplary functional block diagram of a class E cargo compartment fire-suppression system according to an embodiment of the disclosure.

FIG. 4 is an illustration of an exemplary functional block diagram of the class E cargo compartment fire-suppression system 400 (system 400) according to an embodiment of the disclosure. The system 400 may comprise an input module 402, a controller 404, a fire detector 410, a fire-suppression agent supply source 412, a fire-suppression agent time determination module 416, a cabin altitude determination module 420.

The input module 402 is operable to provide input signals to the controller 404. The input signals may comprise, for example but without limitation, a pilot input, a user input, a parameter from a database (e.g., speed, altitude, etc., from a flight control and/or Avionics database), or other input. For example, the input signals may comprise a fire-suppression activation signal, and/or a depressurization signal in response to receiving a fire detection signal. In an event of a fire or smoke detected in the cargo compartment 302, the input signals may be generated automatically or in response to a user or a pilot activating a switch to start distributing a fire-suppression agent in the cargo compartment 302.

The controller 404 may be coupled by an electrical and/or optical signal to the fire/smoke detector 410, the input module 402, and fire-suppression plumbing connection 516/518 (FIG. 5) and control valve(s) 414. The controller 404 is configured to activate the fire-suppression agent supply source 412 based on operational conditions. The operational conditions may comprise, for example but without limitation, the fire-suppression activation time 332/336, the initial fire-suppression time interval T 342, the re-enforcing fire suppression time interval 344, pressure altitude/airplane FL, cabin altitude, cabin PL, takeoff, climb, cruise, descent, landing, a cargo smoke condition, a cargo fire condition, a cargo heat condition, pressurization, depressurization or other condition, and other operational parameter.

The controller 404 manages/controls the fire-suppression agent flow-control valve(s) 414 based on a presence or an absence of fire/smoke in the cargo compartment 302. The controller 404 directs distribution of a fire-suppression agent in response to receiving the fire-warning signal 318 from the fire/smoke detector 410 indicating an out of tolerance smoke condition.

The controller 404 may activate the fire-suppression agent supply source 412 at an activation time based on the operational conditions. The controller 404 detects an operational condition by receiving a signal indicative thereof and directs distribution of a fire-suppression agent accordingly.

For example, the controller 404 directs distribution of the initial fire-suppression agent 324 in the cargo compartment 302 during the depressurization phase 310 at the fire-suppression activation time 332, if the initial fire-suppression time interval T 342 has not elapsed.

For another example, the controller 404 directs distribution of the re-enforcing fire-suppression agent 328 in the cargo compartment 302 during the re-pressurization phase 312 at the fire-suppression activation time 336, when the aircraft FL descends below the aircraft flight level 250 at a cabin FL 20 at about 6.1 km (20,000 feet) equivalent oxygen pressure altitude, if the initial fire-suppression time interval T 342 has elapsed.

Figure 5:
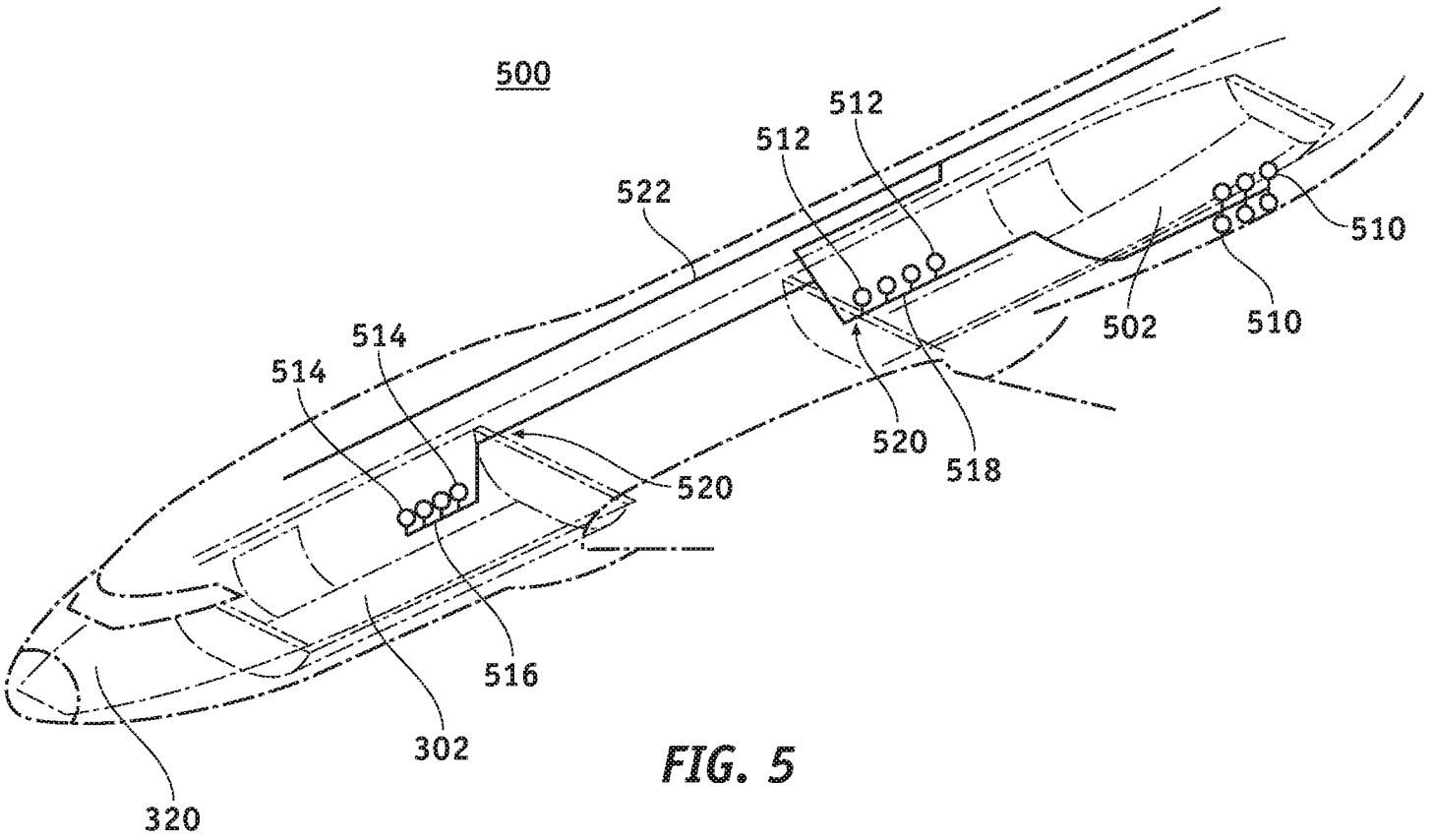
FIG. 5 is an illustration of an exemplary class E cargo compartment of a class E cargo aircraft comprising a class E cargo compartment fire-suppression system according to an embodiment of the disclosure.

In an embodiment, the controller 404 commands an open state in response to receiving the fire-warning signal 318 to open the fire-suppression agent flow-control valve 414, thereby allowing distribution of one or more fire-suppression agent from the fire-suppression agent supply source 412 to cargo volumes 302 in FIGS. 3 and 502 in FIG. 5. For example, if the fire/smoke detector 410 detects an intolerable amount of fire/smoke in the cargo volume 302, the fire/smoke detector 410 sends the fire-warning signal 318 to the controller 404, and the controller 404 opens the fire-suppression agent flow-control valve 414 to the cargo volume 302, while keeping the fire-suppression agent flow-control valve 414 to other cargo volume 502 closed.

The controller 404 may open the fire-suppression agent flow-control valve 414 by sending a signal to an actuator mechanism (not shown) commanding the fire-suppression agent flow-control valve 414 to open. The fire-suppression agent flow-control valve 414 then changes from a closed position to an open position, thereby allowing one or more fire-suppression agent(s) to flow to and through the plumbing connection 504/506 and into the duct system 520 in FIG. 5 of the aircraft 320.

The controller 404 may select a fire-suppression agent such that a flow rate of the fire-suppression agent is based on operational parameters. The operational parameters comprises, for example but without limitation, a contained volume air pressure, an external air pressure, an altitude, a pressure altitude, a rate of change of altitude, a rate of change pressure altitude, a rate of change of air pressure, or other parameter. For example, the controller 404 may monitor an air pressure in the contained volume 302 and control the fire-suppression agent flow-control valve 414. The controller 404 may control the fire-suppression agent flow-control valve 414 such that the initial fire-suppression agent 324 and the re-enforcing fire-suppression agent 328 are distributed respectively as explained above.

After a fire is suppressed, the controller 404 may command a closed state in response to receiving a fire-suppressed signal 418 to close the fire-suppression agent flow-control valve 414, thereby blocking distribution of one or more fire-suppression agents. In this manner, in some embodiments, when a fire is suppressed, the controller 404 sends a signal to the fire-suppression agent flow-control valve 414 to close the fire-suppression agent flow-control valve 414. For example, if the fire/smoke detector 410 detects no intolerable amount of fire/smoke in the cargo volume 302/502 (FIGS. 3 and 6), the fire/smoke detector 410 sends the fire-suppressed signal 418 to the controller 404.

The controller 404 may then send a signal to the actuator mechanism (not shown) of the fire-suppression agent flow-control valve 414 commanding the fire-suppression agent flow-control valve 414 to close. In this manner, in some embodiments, the fire-suppression agent flow-control valve 414 changes from the open position to the closed position thereby blocking the fire-suppression agents from flowing to and through the plumbing connection 516/518 and into the duct system 520 (FIG. 5).

The controller 404 may be implemented as, for example but without limitation, as part of an aircraft-computing module, a centralized aircraft processor, a subsystem-computing module devoted to the system 400, or other configuration. The controller 404 may comprise, for example but without limitation, a software-controlled device, electronic, mechanical, electro-mechanical, fluidic, and other device. The controller 404 may comprise a processor module 406, and memory module 408.

The processor module 406 comprises processing logic that is configured to carry out the functions, techniques, and processing tasks associated with the operation of the system 400. In particular, the processing logic is configured to support the system 400 described herein. For example, the processor module 406 may direct the fire-suppression agent time determination module 416 to determine the fire-suppression activation time 332/336 (FIG. 3) for the fire-suppression agent supply source 412 that should be activated based on various operational conditions.

The processor module 406 may be implemented, or realized, with a general purpose processor, a content addressable memory, a digital signal processor, an application specific integrated circuit, a field programmable gate array, any suitable programmable logic device, discrete gate or transistor logic, discrete hardware components, or any combination thereof, designed to perform the functions described herein. In this manner, a processor may be realized as a microprocessor, a controller, a microcontroller, a state machine, or the like.

A processor may also be implemented as a combination of computing devices comprising hardware and/or software, e.g., a combination of a digital signal processor and a microprocessor, a plurality of microprocessors, one or more microprocessors in conjunction with a digital signal processor core, or any other such configuration.

The memory module 408 may comprise a data storage area with memory formatted to support the operation of the system 400. The memory module 408 is configured to store, maintain, and provide data as needed to support the functionality of the system 400. For example, the memory module 408 may store flight configuration data, the initial fire-suppression time interval T 342, the predetermined time interval ΔT, the re-enforcing fire-suppression time interval 344, the aircraft FLs, the cabin PL, the fire-suppression activation time 332/336, type(s) of fire suppression agent(s) to be activated, or other data.

In some embodiments, the memory module 408 may comprise, for example but without limitation, a non-volatile storage device (e.g., non-volatile semiconductor memory, hard disk device, optical disk device, and the like), a random access storage device (for example, SRAM, DRAM), or any other form of storage medium known in the art.

The memory module 408 may be coupled to the processor module 406 and configured to store, for example but without limitation, a database, a dynamically updating database containing a table for updating the database, or other application. The memory module 408 may also store, a computer program that is executed by the processor module 406, an operating system, an application program, tentative data used in executing a program, or other application.

The memory module 408 may be coupled to the processor module 406 such that the processor module 406 can read information from and write information to the memory module 408. For example, the processor module 406 may access the memory module 408 to access an aircraft speed, an angle of attack, a Mach number, an altitude, the initial fire-suppression time interval T 342, the predetermined time interval ΔT, aircraft FLs, the cabin PL, the predetermined cabin PL, the re-enforcing fire-suppression time interval 344, the fire-suppression activation time 332/336, type(s) of fire-suppression agent(s) to be activated, or other data.

As an example, the processor module 406 and memory module 408 may reside in respective application specific integrated circuits (ASICs). The memory module 408 may also be integrated into the processor module 406. In an embodiment, the memory module 408 may comprise a cache memory for storing temporary variables or other intermediate information during execution of instructions to be executed by the processor module 406.

The controller 404 may be activated, for example but without limitation, automatically, manually, and a combination thereof. The controller 404 may receive an activation signal from the input module 402, from the fire/smoke detector 410, or other warning device.

The fire/smoke detector 410 may be coupled by an electrical and/or optical signal to the controller 404 and is configured to detect fire/smoke conditions. The fire/smoke detector 410 may comprise a device for detecting fire, such as but without limitation, a smoke sensor, a heat sensor, an infrared sensor, and the like. The fire/smoke detector 410 generates the fire-warning signal 318 and the fire-suppressed signal 418 indicating presence and absence of intolerable amount of fire/smoke in a control volume such as the cargo volume 302 and 502.

The fire-suppression supply source 412 may comprise the initial fire-suppression agent 324, an additional fire suppression agent 326, and the re-enforcing fire-suppression agent 328. The fire suppression agent supply source 412 may comprise, for example but without limitation, one or more dedicated high rate discharge descent storage bottles, an inert gas generator such as an On-Board Inert Gas Generation System (OBIGGS), one or more parallel metered system, at least one dump bottle, or other source. Depending on the operational condition such as, but without limitation, the initial fire-suppression time interval T 342, the airplane FL, and the cabin PL, a fire-suppression agent from the fire-suppression agent supply source 412 may be distributed.

The fire suppression agent may be delivered by, for example but without limitation, a storage vessel containing gaseous fire suppressant, an inert gas generator (e.g., an OBIGGS), and other delivery method.

The initial fire-suppression agent 324, and the re-enforcing fire suppressant agent 328 each may comprise active agents or inactive agents, for example but without limitation, gaseous chemical agents such as: HFC-125 or Pentafluoroethane ($CF_3CHF_2$); inert gases and semi-inert gases such as Nitrogen, Argon or Helium; aerosolized liquid mists such as FK 5-1-12 fire protection fluid ($C_6F_{12}O$) (e.g., commercially available from 3M) or water ($H_2O$); Halon 1301 ($CF_3Br$); a mixture thereof, and/or other fire suppression agent.

Accordingly, the fire suppression agent supply source 412 may comprise, for example but without limitation, an OBIGGS, an HFC-125 supply source, a Pentafluoroethane ($CF_3CHF_2$) supply source, a Nitrogen supply source, an Argon supply source, a Helium supply source, an aerosolized liquid mist supply source, a FK 5-1-12 ($C_6F_{12}O$) supply source, a water supply source, a Halon supply source, or other supply source.

The fire suppression agent time determination module 416 is configured to direct the controller 404 to activate the initial fire-suppression agent 324 and the re-enforcing fire-suppression agent 328 at the fire-suppression activation time 332 and 336 respectively. For example, the fire suppression agent time determination module 416 directs the controller 404 to distribute the re-enforcing fire suppression agent 328 in the cargo compartment 302 during the re-pressurization phase 312 at the fire-suppression activation time 336, when a cabin altitude is below the predetermined cabin PL 340 and the aircraft 320 descends from the second altitude to a landing after the initial fire-suppression time interval T 342 has been elapsed.

The initial fire-suppression time interval T 342, the predetermined time interval ΔT, the aircraft FLs, the predetermined cabin PL 340, and types of fire suppression agents to be distributed can be stored in the memory module 408 and accessed by the fire suppression agent time determination module 416.

The cabin altitude determination module 420 is configured to determine the cabin altitude and the cabin PL, and send these data and other information to other modules of the system 400.

The fire-suppression agent flow-control valve 414 may be coupled to the fire suppression agent supply source 412 and the plumbing connection 516/518 (FIG. 5). The fire-suppression agent flow-control valve 414 controls flow of the fire-suppression agent from the fire suppression agent supply source 412 into the plumbing connection 516/518 and to one or more cargo compartment 302/502.

The fire-suppression agent flow-control valve 414 is configured to be in an open state or a closed state depending on presence or absence of fire respectively. Each cargo volume 302/502 may have its own dedicated fire-suppression agent flow-control valve 414 operable to direct flow of the fire-suppression agent from the of fire-suppression agent supply source 412 into the plumbing connection 516/518 of respective cargo volume 302/502.

The fire-suppression agent flow-control valve 414 may comprise, for example but without limitation, a ball valve, a butterfly valve, or other valve. The fire-suppression agent flow-control valve 414 may be actuated, for example but without limitation, electronically, via an actuator, via a gear mechanism, in conjunction with one or more components of the system 400, or other mechanism. As mentioned above, in one embodiment, the flow fire-suppression agent flow-control valve 414 may not be used. For example, if a dedicated fire-suppression bottle 510/512/514 is used for each of the cargo volumes 302/502, the fire-suppression agent flow-control valve 414 may not be used.

An actuator or actuator mechanism coupled to the fire-suppression agent flow-control valve 414 may comprise, for example but without limitation, a hydraulic actuator, a piezoelectric actuator, a spring-loaded mechanism tied or other actuator. Such an actuator may be used for actuation of the fire-suppression agent flow-control valve 414. In an embodiment, the fire-suppression agent flow-control valve 414 comprises a pyrotechnic valve. A pyrotechnic valve may comprise a valve that opens due to a combustive process and remains open until maintenance replaces the valve. An advantage of the pyrotechnic valve is durability and reliability, and an ability to reliably contain a high pressure for substantially long periods of time until opened.

In an embodiment, the fire-warning signal 318 and the fire-suppressed signal 418 may be sent to a control panel (not shown) such as a cockpit control panel. In this manner, an operator such as a pilot or another flight crew member can activate the controller 404 manually via a switch or other activation mechanism to remotely open and/or in some embodiments close the fire-suppression agent flow control valve 414 accordingly.

The fire-suppression agent flow-control valve 414 is operable to control a flow rate of a fire-suppression agent from the fire-suppression agent supply source 412 based on an operational condition as explained above. For example, the controller 404 provides logic such that a flow rate of a fire-suppression agent distributed during cruise is increased during decent. The controller 404 can increase the flow rate of the fire-suppression agent by various control means based on various operational conditions.

For example, the controller 404 increases the flow rate of the fire-suppression agent by controlling the fire-suppression agent flow-control valve 414 based on, for example but without limitation, a flight phase, an altitude, a rate of change of altitude, a rate of ascent of an aircraft, a rate of descent of an aircraft, an ascent signal, a descent signal, a signal from the Flight Management Computer, a speed, a Mach number, a pressure, a rate of change of pressure, a temperature, or other parameter.

FIG. 5 is an illustration of an exemplary class E cargo compartment 500 of the class E cargo aircraft 320 comprising the class E cargo compartment fire-suppression system 400 (FIG. 4) according to an embodiment of the disclosure. The class E cargo compartment 500 may have functions, material, and structures that are similar to the embodiments shown in FIGS. 3-4. Therefore common features, functions, and elements may not be redundantly described here.

In an embodiment, a cargo volume may comprise multiple cargo bays. For example, the class E cargo compartment 500 may comprise an aft cargo volume such as the cargo volume 502 separated by aircraft wings (not shown) from a forward cargo volume such as the cargo volume 302. With two or more cargo bays, the class E cargo compartment 500 suppresses one or more fires whether in a forward cargo volume and/or an aft cargo volume.

Embodiments provide increasing a quantity of the fire-suppression agent discharged to the class E cargo volume 302 and/or 502, or other cargo volume, during a flight, indicated by the controller 404.

Fire-suppression bottles 510/514/516 are examples of the fire-suppression-agent supply source 412 and can be discharged individually or in groups as needed through the plumbing connection 516/518 and into the duct system 520. In an embodiment, the duct system 520 (vehicle ducting 520) of the aircraft 320 may comprise an additional connecting pipe 522 to allow fire distribution agents from various cargo department that do not need fire-suppression to be piped at large quantities to a cargo compartment that needs fire suppression. In this manner, a large quantity of fire-suppressant may be distributed to suppress a fire in the cargo compartment 303/502 more rapidly.

Figure 6:
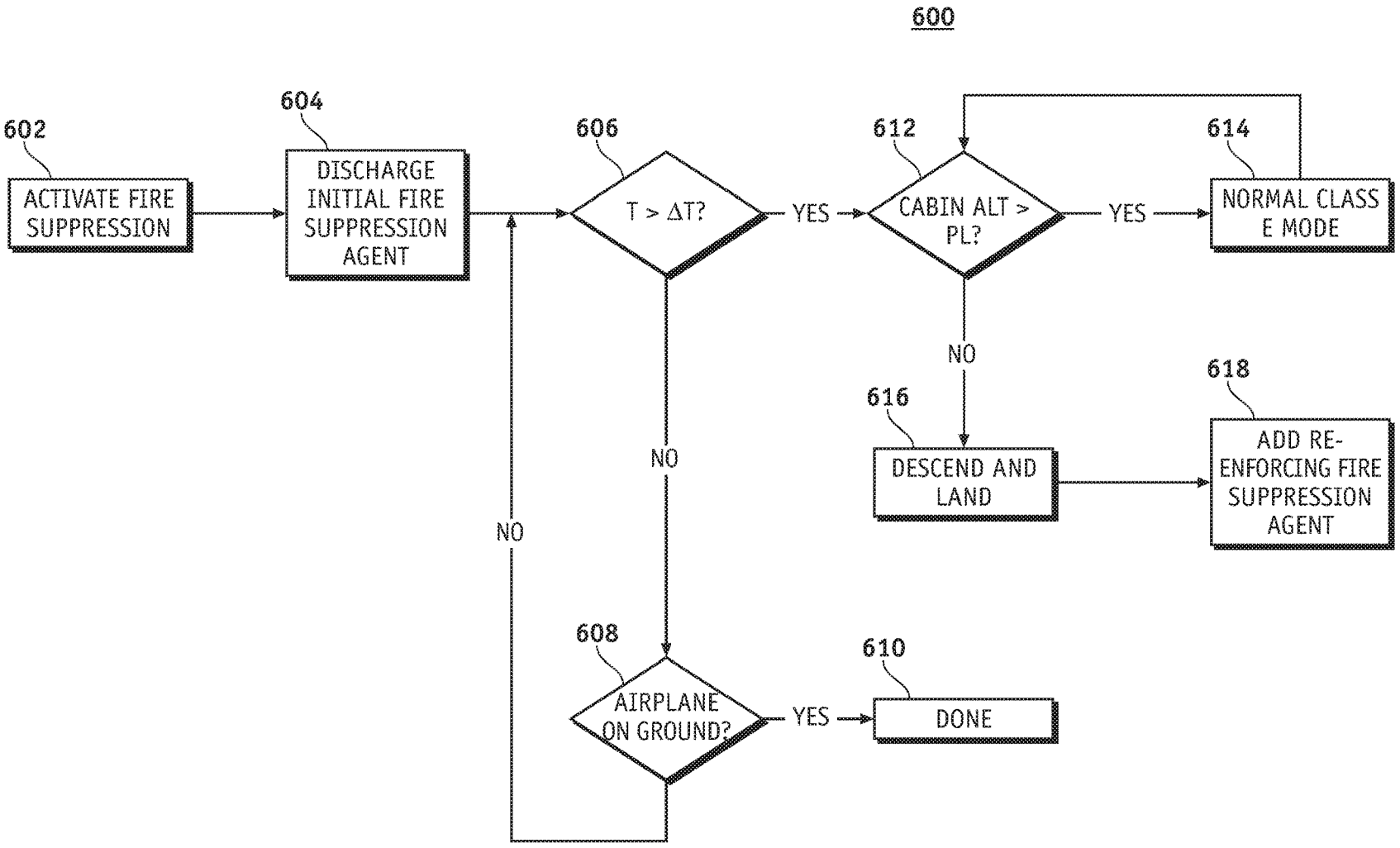
FIG. 6 is an illustration of an exemplary flowchart showing a class E cargo compartment enhanced fire-suppression process according to an embodiment of the disclosure.

FIG. 6 is an illustration of an exemplary flowchart showing a class E cargo compartment enhanced fire-suppression process 600 according to an embodiment of the disclosure. The various tasks performed in connection with process 600 may be performed by software, hardware, firmware, computer-readable software, computer readable storage medium, a computer-readable medium comprising computer executable instructions for performing the process method, mechanically, or any combination thereof. The process 600 may be recorded in a computer-readable medium such as a semiconductor memory, a magnetic disk, an optical disk, and the like, and can be accessed and executed, for example, by a computer CPU such as a processor module in which a computer-readable medium is stored.

For illustrative purposes, the following description of process 600 may refer to elements mentioned above in connection with FIGS. 3-5. In some embodiments, portions of the process 600 may be performed by different elements of the system 400 such as: the input module 402, the controller 404, the fire detector 410, the fire-suppression supply source 412, the fire-suppression agent time determination module 416, the cabin altitude determination module 420, etc. It should be appreciated that the process 600 may include any number of additional or alternative tasks, the tasks shown in FIG. 6 need not be performed in the illustrated order, and the process 600 may be incorporated into a more comprehensive procedure or process having additional functionality not described in detail herein. Process 600 may comprise functions, material, and structures that are similar to the embodiments shown in FIGS. 1-5. Therefore, common features, functions, and elements may not be redundantly described here.

Process 600 may begin by receiving a fire-warning signal such as the fire-warning signal 318 indicating presence of fire in a cargo compartment such as the cargo compartment 302 onboard a class E cargo aircraft such as the class E cargo aircraft 320 at a first altitude (task 602).

Process 600 may continue by distributing an initial fire-suppression agent such as the initial fire-suppression agent 324 in the cargo compartment 302 at the first altitude sufficient to suppress fire for an initial fire-suppression time interval such as the initial fire-suppression time interval T 342 during a depressurization phase such as the depressurization phase 310 during which the class E cargo aircraft 320 flies to a second altitude below the first altitude (task 604). The initial fire-suppression time interval T 342 may comprise, without limitation, about 5 minutes. The initiation fire-suppression agent 324 may be selected based on a worst case scenario such as certain pounds of fire-suppression agent at the sea level.

The first altitude may comprise, for example but without limitation, an airplane FL 360 at about 11 km (36,000 feet) equivalent oxygen pressure altitude, or other airplane FL. The second altitude may comprise, for example but without limitation, an airplane FL 250 at about 7.6 km (25,000 feet) equivalent oxygen pressure altitude, or other airplane FL. The predetermined time interval ΔT may comprise, for example but without limitation, about 5 minutes for the class E cargo aircraft 320, or other initial fire-suppression time interval depending on an aircraft operation. As mentioned above, the initial fire-suppression time interval T 342 is defined as a time interval during which the initial fire-suppression agent 324 should maintain fire-suppression capability until the aircraft 320 reaches a low oxygen level that is low enough to maintain fire suppression. For example, the initial fire-suppression time interval T 342 may depend on the aircraft 320 depressurization rate and descent rate.

Process 600 may continue by determining whether the initial fire-suppression time interval T 342 is greater than the predetermined time interval ΔT (indicating initial fire-suppression time interval T 342 has elapsed) (inquiry task 606).

If the initial fire-suppression time interval T 342 is less than the predetermined time interval ΔT (indicating initial fire-suppression time interval T 342 has not elapsed) (NO branch of inquiry task 606), then process 600 determines whether the aircraft 320 is on the ground (inquiry task 608). If the aircraft 320 is on the ground (YES branch of inquiry task 608) then process 600 ends (task 610).

Otherwise, if the aircraft 320 is not on the ground (NO branch of inquiry task 608) then process 600 leads back to the inquiry task 606. If the initial fire-suppression time interval T 342 is greater than the predetermined time interval ΔT (indicating initial fire-suppression time interval T 342 has not elapsed) (YES branch of inquiry task 606), then process 600 determines whether the cabin altitude is greater than a predetermined cabin pressure level (PL) (inquiry task 612). If the cabin altitude is greater than the predetermined cabin pressure level (PL) (YES branch of inquiry task 612), then process 600 continues according to a normal class E mode (task 614). The predetermined cabin pressure level PL, may comprise, for example but without limitation, about 6.1 km (20,000 feet) equivalent oxygen pressure altitude, or other cabin pressure level (PL) depending on an aircraft operation.

If the cabin altitude is less than the predetermined cabin pressure level (PL) (NO branch of inquiry task 612), then process 600 distributes a re-enforcing fire-suppression agent such as the re-enforcing fire-suppression agent 328 in the cargo compartment 302 (task 618) during the re-pressurization phase 312 during which the class E cargo aircraft 320 flies from the second altitude to a landing (task 616).

The re-enforcing fire-suppression agent 328 may comprise a metered fire-suppression system, a storage bottle, a dump bottle, or other type of fire-suppression delivery system suitable for operation of the system 400. As mentioned above distribution of the re-enforcing fire-suppression agent 328 is maintained during the re-enforcing fire-suppression time interval 344. The re-enforcing fire-suppression time interval 344 depends on an amount of time for the aircraft 320 to land safely. For example, the re-enforcing fire-suppression time interval 344 may comprise, for example but without limitation, about 23 minutes, 24 minutes, or other value.

Figure 7:
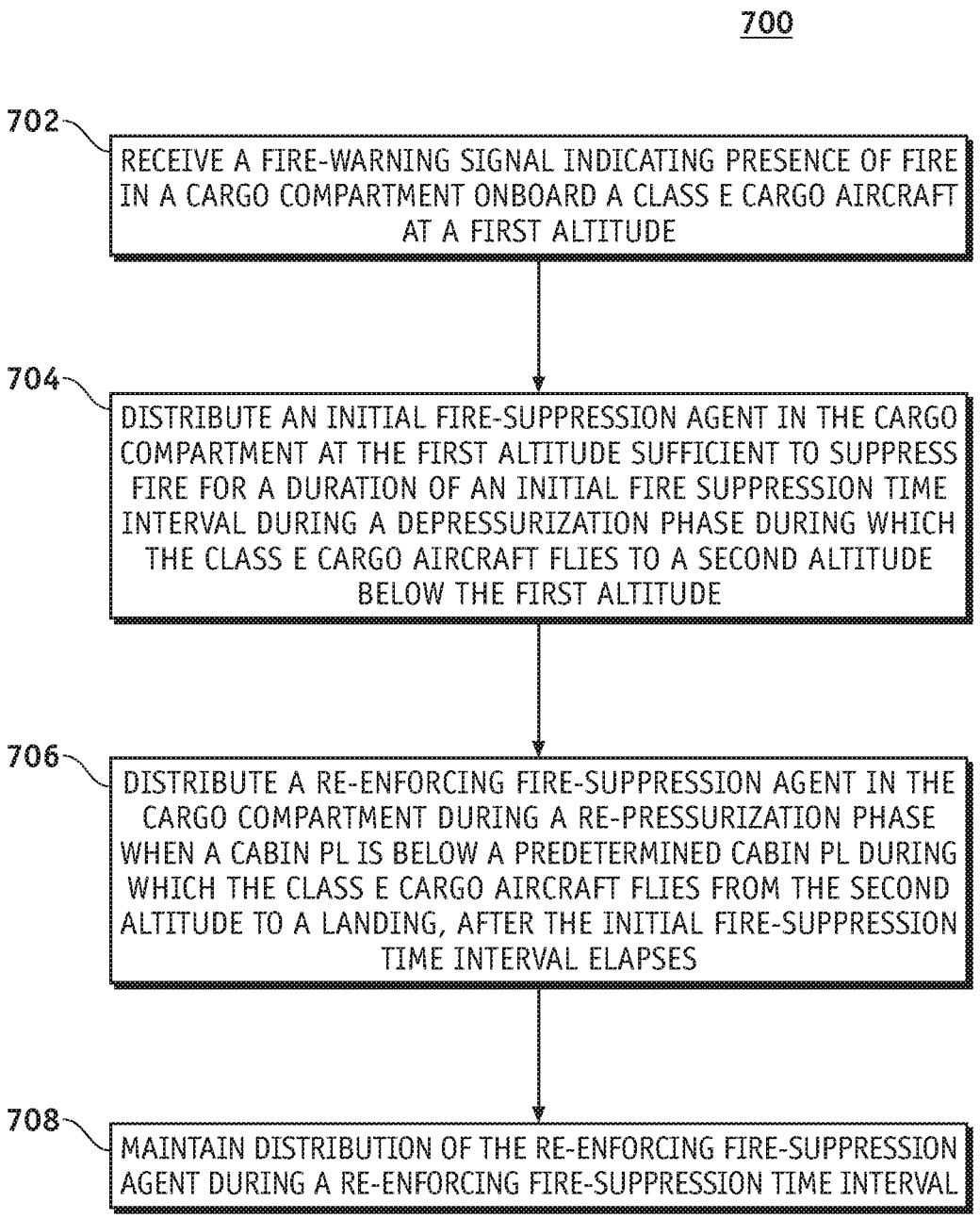
FIG. 7 is an illustration of an exemplary flowchart showing a class E cargo compartment fire-suppression process according to an embodiment of the disclosure.

FIG. 7 is an illustration of an exemplary flowchart showing a class E cargo compartment fire-suppression process 700 according to an embodiment of the disclosure. The various tasks performed in connection with process 600 may be performed by, an operator action, software, hardware, firmware, computer-readable software, computer readable storage medium, a computer-readable medium comprising computer executable instructions for performing the process method, mechanically, or any combination thereof. The process 700 may be recorded in a computer-readable medium such as a semiconductor memory, a magnetic disk, an optical disk, and the like, and can be accessed and executed, for example, by a computer CPU such as a processor module in which a computer-readable medium is stored.

For illustrative purposes, the following description of process 700 may refer to elements mentioned above in connection with FIGS. 1-5. In some embodiments, portions of the process 700 may be performed by different elements of the system 400 such as: the input module 402, the controller 404, the fire detector 410, the fire-suppression supply source 412, the fire-suppression agent time determination module 416, the cabin altitude determination module 420, etc.

It should be appreciated that the process 700 may include any number of additional or alternative tasks, the tasks shown in FIG. 6 need not be performed in the illustrated order, and the process 700 may be incorporated into a more comprehensive procedure or process having additional functionality not described in detail herein. Process 700 may comprise functions, material, and structures that are similar to the embodiments shown in FIGS. 3-5. Therefore, common features, functions, and elements may not be redundantly described here.

Process 700 may begin by receiving a fire-warning signal such as the fire-warning signal 318 indicating presence of fire in a cargo compartment such as the cargo compartment 302 onboard a class E cargo aircraft such as the class E cargo aircraft 320 at a first altitude (task 702).

Process 700 may continue by distributing an initial fire-suppression agent 324 such as the initial fire-suppression agent 324 in the cargo compartment 302, at the first altitude, sufficient to suppress fire for a duration of an initial fire-suppression time interval such as the initial fire-suppression time interval T 342 during a depressurization phase such as the depressurization phase 310 during which the class E cargo aircraft 320 flies to a second altitude below the first altitude (task 704). Start of distribution of the initial fire-suppression agent 324 establishes a start of the initial fire-suppression time interval T 342.

Process 700 may continue by distributing a re-enforcing fire-suppression agent such as the re-enforcing fire-suppression agent 328 in the cargo compartment 302 during a re-pressurization phase such as the re-pressurization phase 312 when the cabin altitude is below a predetermined cabin pressure level (PL) such as the predetermined cabin PL 340 during which the class E cargo aircraft 320 flies from the second altitude to a landing, after the initial fire-suppression time interval T 342 elapses (task 706).

Process 700 may continue by maintaining distribution of the re-enforcing fire-suppression agent 328 during a re-enforcing fire-suppression time interval such as the re-enforcing fire-suppression time interval 344 (task 708).

In this manner, various embodiments of the disclosure provide a system and method for suppressing fire using an enhance class E fire-suppression distribution system based on an operational condition.

While at least one example embodiment has been presented in the foregoing detailed description, it should be appreciated that a vast number of variations exist. It should also be appreciated that the example embodiment or embodiments described herein are not intended to limit the scope, applicability, or configuration of the subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

In this document, the term "module" as used herein, refers to software, firmware, hardware, and any combination of these elements for performing the associated functions described herein. Additionally, for purpose of discussion, the various modules are described as discrete modules; however, as would be apparent one of skilled in the art, two or more modules may be combined to form a single module that performs the associated functions according the embodiments of the present disclosure.

In this document, the terms "computer program product", "computer-readable medium", non-transitory computer readable storage medium, and the like may be used generally to refer to media such as, for example, memory, storage devices, or storage unit. These and other forms of computer-readable media may be involved in storing one or more instructions for use by the processor module 406, and the controller 404 each cause the processor module 406, and the controller 404 to perform specified operations respectively. Such instructions, generally referred to as "computer program code" or "program code" (which may be grouped in the form of computer programs or other groupings), when executed, enable a method of using the system 400.

The above description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIGS. 3-5 depict example arrangements of elements, additional intervening elements, devices, features, or components may be present in an embodiment of the disclosure.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent. The term "about" when referring to a numerical value or range is intended to encompass values resulting from experimental error that can occur when taking measurements.

As used herein, unless expressly stated otherwise, "operable" means able to be used, fit or ready for use or service, usable for a specific purpose, and capable of performing a recited or desired function described herein. In relation to systems and devices, the term "operable" means the system and/or the device is fully functional and calibrated, comprises elements for, and meets applicable operability requirements to perform a recited function when activated. In relation to systems and circuits, the term "operable" means the system and/or the circuit is fully functional and calibrated, comprises logic for, and meets applicable operability requirements to perform a recited function when activated.

The invention claimed is:

1. A cargo fire-suppression agent distribution system comprising:

a fire detector operable to receive a fire-warning signal indicating presence of fire in a cargo compartment of an aircraft, the aircraft receiving the fire-warning signal while the aircraft is at a first altitude;

a fire-suppression agent time determination module operable to activate an initial fire suppression agent and a re-enforcing fire-suppression agent at a first activation time and a second activation time, respectively; and a controller operable to:

distribute the initial fire-suppression agent in the cargo compartment at the first altitude sufficient to suppress fire for an initial fire-suppression time interval, during which the aircraft enters a depressurization phase and flies to a second altitude below the first altitude;

block distribution of any fire-suppression agent for a time interval in response to a determination that the aircraft has reached a predetermined low oxygen level sufficient to maintain fire-suppression, wherein the time interval follows the initial fire-suppression time interval;

distribute the re-enforcing fire-suppression agent in the cargo compartment after the time interval elapses during a re-pressurization phase, when a cabin altitude is below a predetermined cabin pressure level (PL) and the aircraft descends from the second altitude to a landing; and maintain distribution of the re-enforcing fire-suppression agent during a re-enforcing fire-suppression time interval.

2. The cargo fire-suppression agent distribution system of claim 1, wherein the first altitude is about 11 km (36,000 feet) equivalent oxygen pressure altitude.

3. The cargo fire-suppression agent distribution system of claim 1, wherein the second altitude is about 7.6 km (25000 feet) equivalent oxygen pressure altitude.

4. The cargo fire-suppression agent distribution system of claim 1, wherein the predetermined cabin PL is equivalent to an atmospheric pressure at about 6.1 km (20,000 feet) equivalent oxygen pressure altitude.

5. The cargo fire-suppression agent distribution system of claim 1, wherein the initial fire-suppression time interval is about 5 minutes.

6. The cargo fire-suppression agent distribution system of claim 1, wherein the re-enforcing fire-suppression time interval is about 23 minutes.

7. The cargo fire-suppression agent distribution system of claim 1, wherein the initial fire-suppression agent and the re-enforcing fire-suppression agent each comprises at least one of the group consisting of: an active agent, and Halon.

8. The cargo fire-suppression agent distribution system of claim 7, wherein the active agent comprises at least of one of the group consisting of: HFC-125, Pentafluoroethane (CF3CHF2), Nitrogen, Argon, Helium, aerosolized liquid mist, fire protection fluid (C6F12O), and water.

9. The cargo fire-suppression agent distribution system of claim 1, wherein the initial fire-suppression agent and the re-enforcing fire-suppression agent are supplied by a fire-suppression agent supply source coupled to a vehicle ducting.

10. The cargo fire-suppression agent distribution system of claim 9, wherein the fire-suppression agent supply source comprises at least one member selected from the group consisting of: a metered system, a descent storage bottle, and a dump bottle.

11. The cargo fire-suppression agent distribution system of claim 9, wherein the fire-suppression agent supply source comprises at least one member selected from the group consisting of: a storage bottle, an On-Board Inert Gas Generation System (OBIGGS), an HFC-125 supply source, a Pentafluoroethane (CF3CHF2) supply source, a Nitrogen supply source, an Argon supply source, a Helium supply source, an aerosolized liquid mist supply source, an FK 5-1-12 (C6F12O) supply source, a water supply source, and a Halon supply source.

12. A method for enhancing fire-suppression, comprising:

receiving, by a fire detector of a cargo fire-suppression agent distribution system, a fire-warning signal indicating presence of fire in a cargo compartment of an aircraft, the fire detector receiving the fire-warning signal while the aircraft is at a first altitude;

distributing, by the cargo fire-suppression agent distribution system, an initial fire-suppression agent in the cargo compartment at the first altitude sufficient to suppress fire for an initial fire-suppression time interval, during which the aircraft enters a depressurization phase and flies to a second altitude below the first altitude;

blocking distribution of any fire-suppression agent for a time interval in response to a determination that the aircraft has reached a predetermined low oxygen level sufficient to maintain fire-suppression, wherein the time interval follows the initial fire-suppression time interval;

distributing, by the cargo fire-suppression agent distribution system, a re-enforcing fire-suppression agent in the cargo compartment after the time interval elapses during a re-pressurization phase, when a cabin altitude is below a predetermined cabin pressure level (PL) and the aircraft descends from the second altitude to a landing; and maintaining, by the cargo fire-suppression agent distribution system, distribution of the re-enforcing fire-suppression agent during a re-enforcing fire-suppression time interval.

13. The method of claim 12, wherein the first altitude is about 11 km (36,000 feet) equivalent oxygen pressure altitude, and wherein the second altitude is about 7.6 km (25000 feet) equivalent oxygen pressure altitude.

14. The method of claim 12, wherein the predetermined cabin PL is equivalent to an atmospheric pressure at about 6.1 km (20,000 feet) equivalent oxygen pressure altitude.

15. The method of claim 12, wherein the initial fire-suppression time interval is about 5 minutes, and wherein the re-enforcing fire-suppression time interval is about 23 minutes.

16. The method of claim 12, wherein the initial fire-suppression agent and the re-enforcing fire-suppression agent each comprises at least one of the group consisting of: an active agent, and Halon.

* * * * *